US006485010B1

(12) United States Patent
Lamothe

(10) Patent No.: US 6,485,010 B1
(45) Date of Patent: Nov. 26, 2002

(54) METHOD AND APPARATUS FOR SEPARATING A STREAM OF DOCUMENTS INTO DISCRETE GROUPS

(75) Inventor: Richard P. Lamothe, Burlington, CT (US)

(73) Assignee: Energy Saving Products and Sales Corporation, Burlington, CT (US)

( * ) Notice: Subject to any disclaimer, the term of this patent is extended or adjusted under 35 U.S.C. 154(b) by 0 days.

(21) Appl. No.: 09/565,547

(22) Filed: May 5, 2000

Related U.S. Application Data

(60) Provisional application No. 60/134,393, filed on May 14, 1999, and provisional application No. 60/162,336, filed on Oct. 29, 1999.

(51) Int. Cl.[7] ..... B65H 29/00

(52) U.S. Cl. ..... 270/52.09; 414/791.2; 271/270; 271/250; 225/100

(58) Field of Search ..... 414/791.2, 790.7, 414/790.8, 791, 6; 270/52.02, 52.07, 52.09; 198/418.8, 440, 436, 369.3; 271/207, 205, 270; 225/100

(56) References Cited

U.S. PATENT DOCUMENTS 3,860,127 A * 1/1975 Fassman ..... 414/791.2
4,091,978 A * 5/1978 Graham, II ..... 414/791.2 X
4,905,979 A * 3/1990 Limbach et al. ..... 414/791.2 X
5,158,278 A * 10/1992 Auf der Mauer ..... 270/270
5,540,370 A * 7/1996 Ring ..... 271/250 X
5,704,604 A * 1/1998 Koelle et al. ..... 270/52.07 X

* cited by examiner

*Primary Examiner*—Christopher P. Ellis
*Assistant Examiner*—Patrick Mackey
(74) *Attorney, Agent, or Firm*—McCormick, Paulding & Huber LLP

(57) ABSTRACT

An apparatus and process are provided for separating one or more endless streams of pages into corresponding staggered stacks of reports for further processing. Each page of a first report is taken from the endless stream and moved into a first position on a first stack of reports, and each page of the next subsequent report is moved onto a second stack staggered from the first. This process is continued indefinitely. Alternatively, more than two stacks can be provided for. Also, numerous endless streams of pages, in side-by-side relation, can be stacked into a plurality of stacks of reports in side-by-side relation so as to be conveniently assembled for further processing.

13 Claims, 7 Drawing Sheets

METHOD AND APPARATUS FOR SEPARATING A STREAM OF DOCUMENTS INTO DISCRETE GROUPS

CROSS REFERENCE TO RELATED APPLICATIONS

This application claims priority under 35 U.S.C. § 119 (e) of co-pending provisional application Ser. No. 60/134,393 (filed May 14, 99) and Ser. No. 60/162,336 (filed Oct. 29, 1999).

FIELD OF THE INVENTION

This invention relates generally to forming discrete bundles of documents from a continuous stream of documents. It relates more particularly to a method and apparatus for forming stacks of documents of a predetermined number from a stream of documents.

BACKGROUND OF THE INVENTION

Modern paper processing lines provide printing on large numbers of documents on a high speed printer in short times. Whether printed from a paper web and subsequently cut into individual pages, or printed on precut sheets, the individual pages are outputted in a continuous stream along a conveyor system. These pages are cut, both transversely and longitudinally in modern high speed sheet cutting units, providing side-by-side streams of paper sheets or pages that must be merged and sorted into books, reports, multi-page invoices, and the like. For brevity, any such discrete group of documents is herein referred to as a report. A problem arises in sorting these pages into discrete ready-to-ship reports, and keeping each report separate from every other report.

The prior art has typically resolved this problem by staggering the stream of documents between reports. Specifically, each page of a report in the prior art is made to overlap another page of the same report, and each report is separated by a gap in the document stream. See U.S. Pat. No. 5,704,604 and DE-A-1 436 485 for some examples of this technique. But simultaneously overlapping individual pages while imposing gaps between other pages, without curtailing printer speed and efficiency, necessarily imposes other problems that must be overcome by ever more complicated arrangements. For example, U.S. Pat. No. 5,704,604 includes rollers to force the individual pages of a report to overlap each other, but which also restrict forward movement of the first few pages of a report to create a gap between reports. These opposing manipulations of the document stream must occur without slowing the overall document stream.

From the broadest perspective then, the prior art takes an endless stream of documents in succession, compresses a portion of the stream by overlapping pages, and subsequently expands another portion of the stream to create a gap between reports. While this method may be effective, it is unnecessarily complicated and imposes certain deficiencies. A single torn or mis-aligned page in the prior art will interrupt the flow and separation of numerous reports, rather than limit the discrepancy to a single report. Multiple unconnected mechanical systems must work in synchronous high speed. The machinery takes up space that is at a premium in commercial print shops. And since most print jobs are multiple printings of reports having the same number of pages, such as books, reports, mass mailings, and the like, the additional capabilities of prior art devices to handle reports of varying page numbers is unused throughout most of the industry.

What is needed in the art is a cost effective and space saving apparatus that separates multi-page reports of a predetermined page number, and a method to do the same. It is an object of the present invention to provide such an apparatus and method, one that overcomes some of the above listed deficiencies in the prior art. As with any invention, simpler solutions tend to be less expensive, more reliable, and more adaptable to varied applications, so it is a further object of this invention to provide an apparatus and method that are simpler than the prior art.

SUMMARY OF THE INVENTION

In accordance with the present invention, a machine is provided to separate a continuous stream of pages into discrete reports. This machine comprises a conveyor means to provide a continuous stream of pages seriatim in a first direction, means to determine which page in the continuous stream is a last page of a report, means for moving each page of a report from the continuous stream onto a first location of a holding area, and means for shifting each page immediately following a last page of a report, until and including the last page of the next subsequent report, onto a second location of the holding area, said second location being shifted either laterally or longitudinally from said first location. The conventions 'last page' and 'report' used herein are explicitly specified in other sections of this disclosure.

The present invention also includes the method for separating one or more endless stream of pages into one or more corresponding stacks of reports. This method comprises the steps of moving each page of a report from the endless stream into a first position on a holding area, determining which page in the endless stream of pages is a last page of a report, and moving each page immediately following said last page of a report, until and including the last page of the next subsequent report, to a second position on a holding area, said second position being staggered from said first position.

The present invention thereby takes an endless stream of individual pages and divides them into discrete reports, said reports formed into a staggered stack such that each discrete report only partially overlaps adjacent reports.

The present invention includes forming a single staggered stack of reports from a single endless stream of pages, and multiple staggered stacks of reports from multiple endless streams of documents, each staggered stack of reports corresponding to one endless stream of pages.

The preferred embodiment employs an overhead conveyor system to move each page from the endless stream into one of the two positions that make up the staggered stack of reports. This embodiment uses a fixed driven shaft located nearest the endless stream of documents and two opposing idling shafts, each connected to the driven shaft by rubber conveyor belts or bands.

A variable speed motor powers the driven shaft so that the shaft's speed moves each page faster than the incoming stream of documents, thus 'pulling' each individual page from the stream. A single speed motor driving the shaft faster than the incoming stream of pages is sufficient for simple applications where the variety of print jobs does not greatly vary. Where the upstream printing and cutting devices are capable of delivering streams of documents over a very wide variety of speeds into the present invention, such as in highly flexible commercial printing operations, a variable speed motor that can more closely match the speed of the incoming document stream may alternatively be provided.

The belts connecting one idling shaft direct pages toward a first position on the staggered stack of reports and the belts connecting the other idling shaft direct pages toward a second position. The idling shafts are alternately raised or lowered so that only one set of belts contacts the incoming page, directing it to one or the other position. These idling shafts may either be horizontal, or may be canted downward and away from the centerline of the staggered stack. When horizontal, the conveyor belts or bands angle away from the longitudinal centerline of the staggered stack so as to direct each page to one side or the other of the stack of reports. When canted, the conveyor belts may be parallel to the longitudinal centerline, and the cant of the successive belts drives each page to one side or the other of the staggered stack of reports.

An alternative embodiment comprises a single idling shaft that is laterally shiftable, or two idling shafts operating in unison, thus directing each incoming page toward the first or second position on the holding area. Multiple such overhead conveyor systems may be employed in side-by-side relation to each other in order to handle multiple endless streams of documents.

Another alternative embodiment staggers the stacks of reports longitudinally rather than laterally, to better enable the handling of more than two endless streams of documents considering space restraints imposed by lateral staggering of stacks of reports. This embodiment also employs overhead conveyor systems, but wherein the speed of the conveyor system varies to move any individual page to either of the longitudinally staggered positions. The idling shaft of this embodiment is not laterally shiftable as above.

Further details regarding specific embodiments are expounded in the following sections.

BRIEF DESCRIPTION OF THE DRAWINGS

A more complete understanding of the present invention and many of its attendant advantages will be readily appreciated and better understood by reference to the following detailed description when considered in conjunction with the accompanying drawings, wherein.

DETAILED DESCRIPTION OF THE PREFERRED AND ALTERNATIVE EMBODIMENTS

Figure 1:
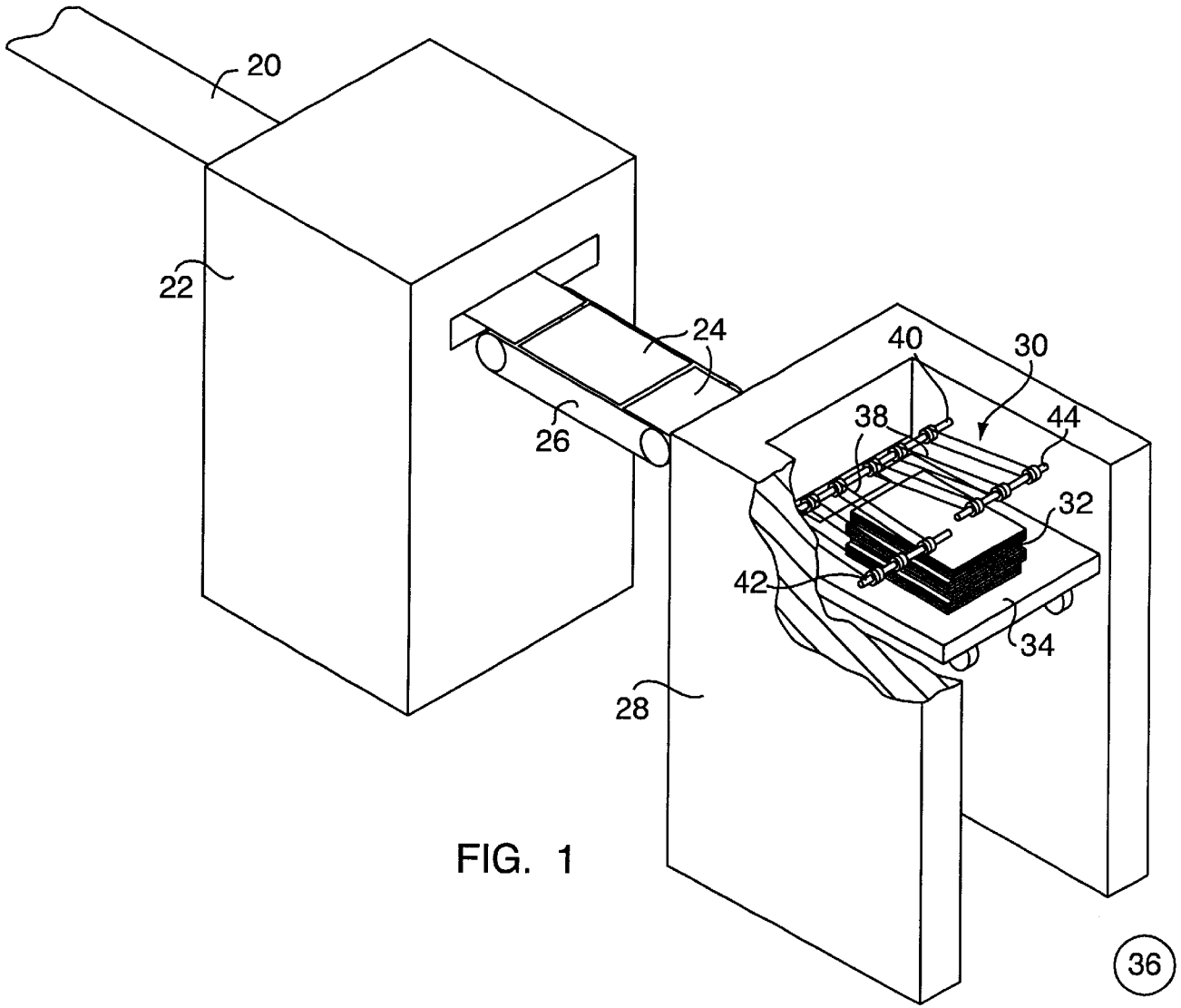
FIG. 1 is a perspective view of the preferred embodiment in relation to a printing process line.

Turning now to the drawings in greater detail, FIG. 1 shows a generalized schematic of the preferred embodiment of the present invention in relation to a printing process line. A continuous web 20 is fed into a sheet cutter unit 22 or other upstream paper-handling device 22. Cut sheets 24 are fed from the device 22 onto a conveyor 26. The conveyor 26 feeds the continuous steam of cut sheets 24 into a separator unit 28 of the present invention. A sorting mechanism 30 directs each cut sheet 24 onto one side or the other of a staggered stack of reports 32 that rests on a floating table 34. The floating table 34 has a horizontal work surface that is moveable in the vertical direction. In this instance, it is spring, motor, or otherwise controlled so that the addition of more cut sheets drives the horizontal surface of the table downward approximately the width of the added cut sheets, and the top of the staggered stack 32 stays within a relatively constant horizontal plane.

Figure 9:
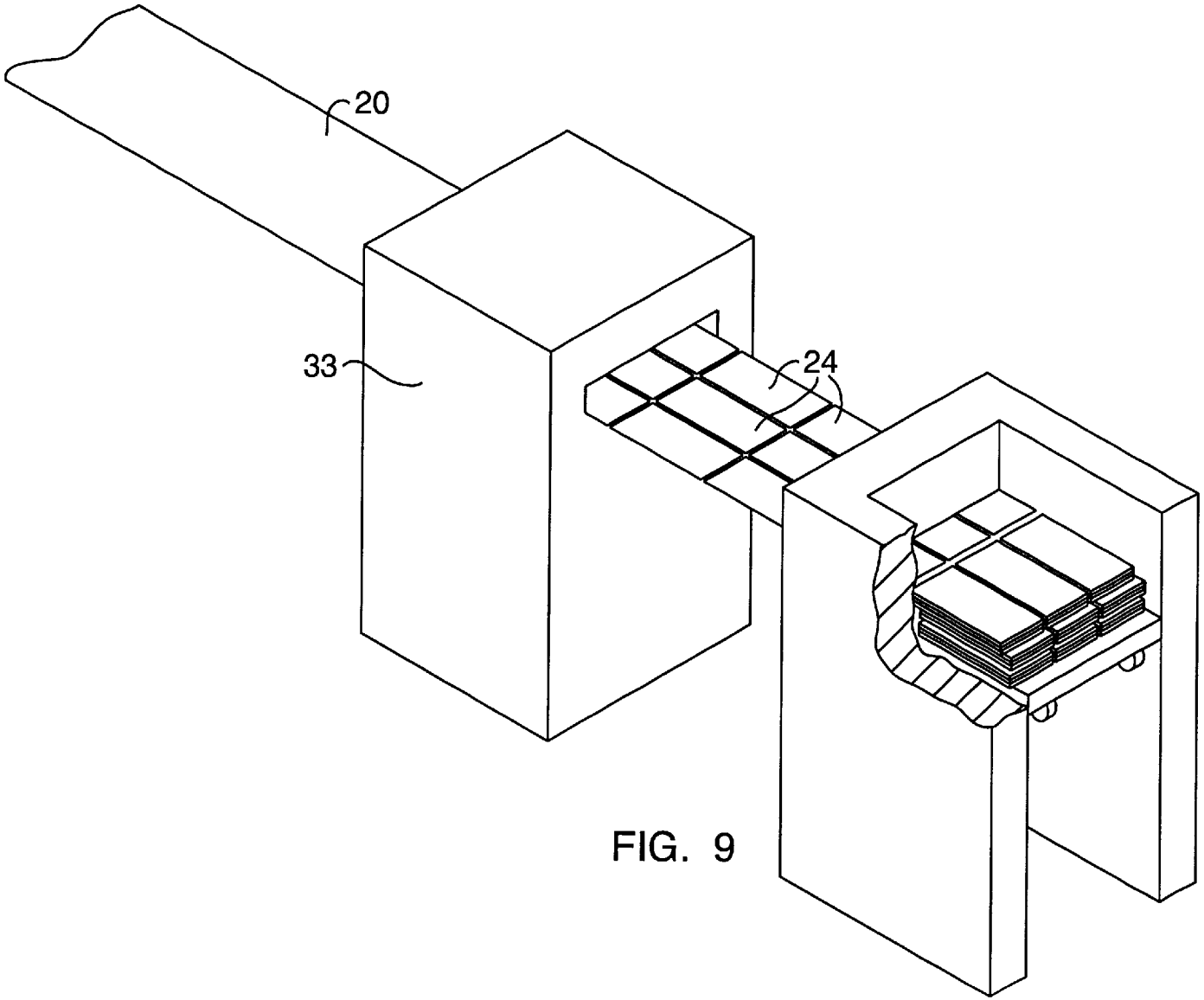
FIG. 9 is a perspective view of the third alternative embodiment in relation to a printing process line.

The sorting mechanism 30 of the preferred embodiment engages the top of each cut sheet 24 as it enters the separator unit 28 to direct said sheets to the staggered stacks 32. For convention, laterally staggered stacks are as shown in FIG. 1, and longitudinally staggered stacks are as shown in FIG. 9. Since the overwhelming majority of print operations have the printed side of the cut sheets 24 facing up as they pass over the conveyor 26, reports are typically printed and stacked from the last written page to the first. For the purposes of this disclosure and the claims, the last page of a report refers to the last page as stacked in the illustrations, and may be a collated report's first or last page as read by an observer.

Figure 2:
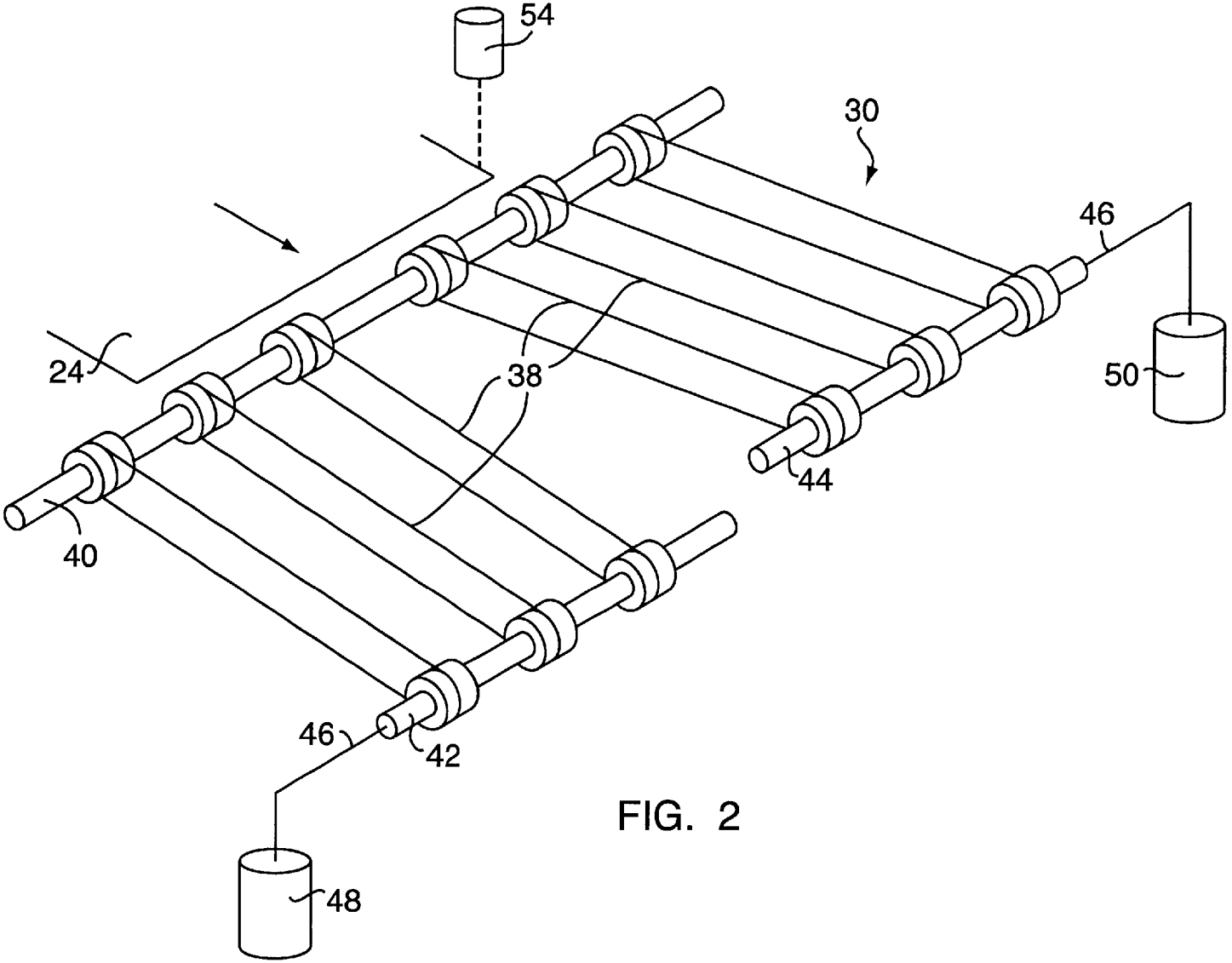
FIG. 2 is an isolated perspective view of the sorting mechanism of the preferred embodiment.

FIG. 2 shows the sorting mechanism 30 of the present invention in greater detail. A cut sheet 24 is engaged by conveyor belts or bands 38, one set of conveyor bands being mounted between a driven axle 40 and a first idling axle 42, and the other set mounted between the driven axle 40 and a second idling axle 44. Extending from each idling axle is a crank arm 46 by which a first air cylinder 48 positions the first idling axle and a second air cylinder 50 positions the second idling axle to redirect each cut sheet 24 to its respective report.

Figure 3:
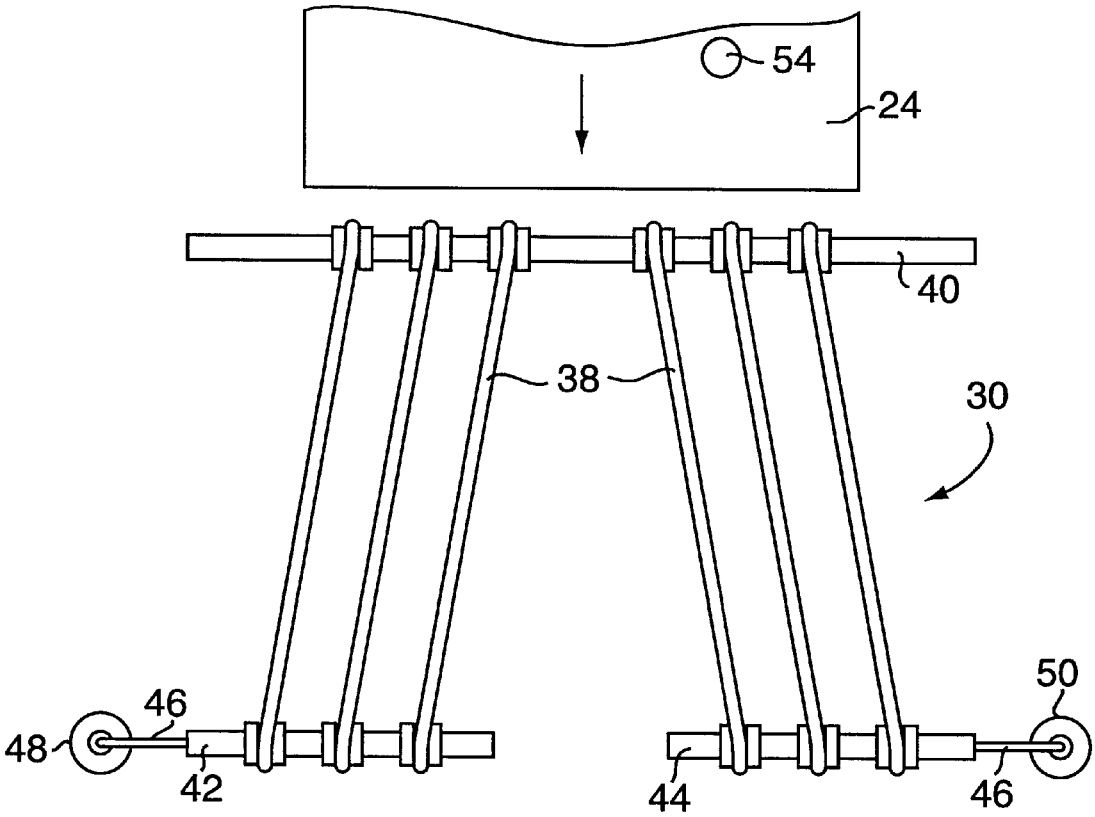
FIG. 3 is a top view of the sorting mechanism of the preferred embodiment.
Figure 4:
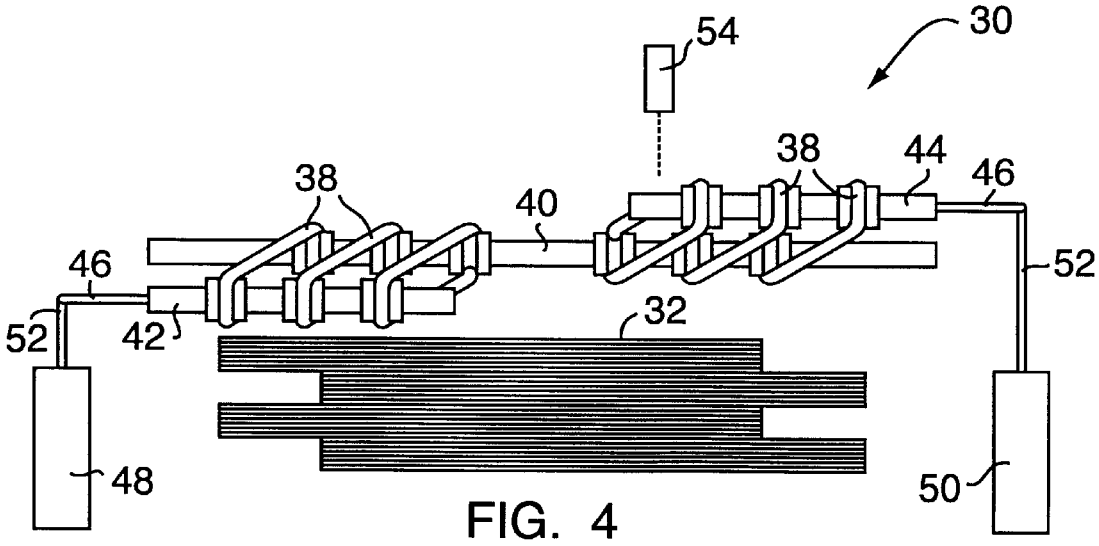
FIG. 4 is a plan view of the sorting mechanism of the preferred embodiment.

The sorting mechanism of the preferred embodiment is shown in overhead view at FIG. 3 and plan view in FIG. 4, the plan view being that seen by an observer at position 36 shown in FIG. 1. The cut sheet 24 passes underneath the driven axle 40 and is engaged by the three conveyor bands 38 at the left of the drawing, which span the driven axle 40 and the first idling axle 42. These three conveyor bands draw the cut sheet 24 to the left side of the staggered stack 32. The horizontal position of the idling axles is evident in FIG. 4, wherein an actuator 52 of the first air cylinder 48 is compressed so that the three conveyor bands 38 spanning the first idling axle 42 engage the incoming cut sheet 24. Conversely, the actuator 52 of the second air cylinder 50 is extended so that the three conveyor bands 38 spanning the second idling axle 44 are raised and do not engage the incoming cut sheet 24. After the last page of a 15 report is placed upon the left side of staggered stack of reports 32 as shown in FIG. 4, the idling axles change positions so that the actuator 52 of the first air cylinder 48 is extended and that of the second air cylinder 50 is compressed. Thereby the next subsequent cut sheet 24 is the first page of the next subsequent report, and is engaged by the conveyor bands 38 of the second idling axle 44 which places it on the right side of the staggered stack of reports 32. Means is provided to identify the last page of a report, which means preferably is an optical scanner device or sensor 54 to sense a preprinted mark on the last page of each report, or elapsed pages passing into the sorting mechanism. The sensor 54 identifies optical markings on the last page of each report.

Alternatively, a roller mechanically measures elapsed linear or angular distance, or other similar means used to distinguish the pages of the reports. A mechanical stop (not shown) is preferably provided at the downstream end of the process line (i.e. the bottom of FIG. 3, for example) to keep the reports and individual pages thereof neatly aligned. Additional stops (not shown) may be mounted on the left side of the first idling axle 42 to accurately align the left edge of each report on the left side of the staggered stack 32, and on the right side of the second idling axle 44 to align the right edge of each report on the right side of the staggered stack 32.

Figure 6:
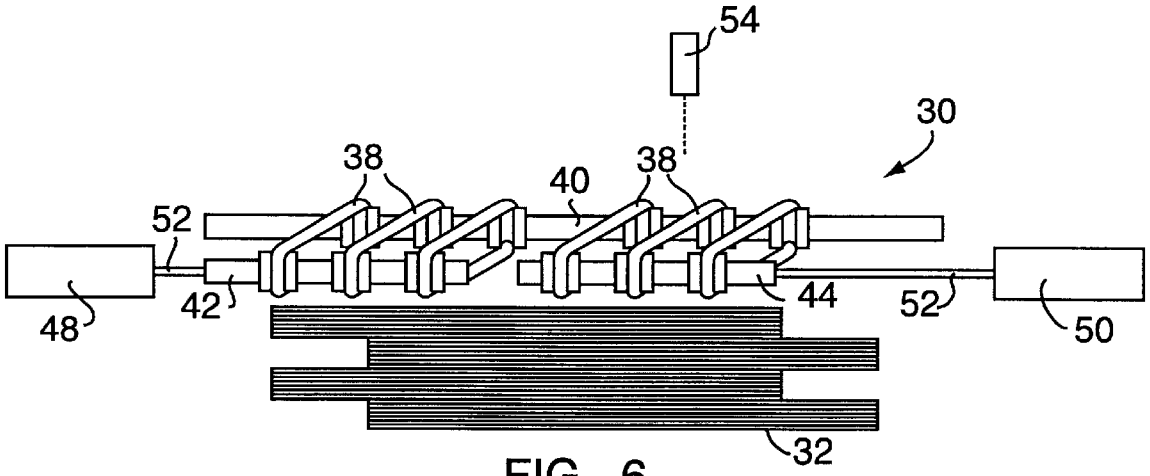
FIG. 6 is a plan view of the sorting mechanism of the first alternative embodiment using split idling axles.

The first alternative embodiment of the present invention is shown at FIG.'S 5 through 7, wherein the plan view of FIG. 6 is that seen by an observer at position 36 shown in FIG. 1. The air cylinders are repositioned so that their actuators 52 move substantially parallel with the idling axles 42 and 44. The first and second air cylinders 48 and 50 act in unison to position the first and second idling axles 42 and 44 substantially equidistant from each other throughout this embodiment's operation. Rather than moving the idling axles vertically, they are moved horizontally to position each cut sheet either to the left side (as shown in FIG. 6) or to the right side of the staggered stack of reports 32. Each of the six conveyor bands 38 shown engage each cut sheet 24, regardless of which side of the staggered stack 32 that sheet ultimately reposes. Once the last page of a report is placed with its respective report on the left side of the staggered stack 32, the air cylinders 48 and 50 move the idling axles 42 and 44 to the right, placing the next subsequent cut sheet 24, which is the bottom or first stacked page of the next subsequent report, onto the right side of the staggered stack 32.

Figure 5:
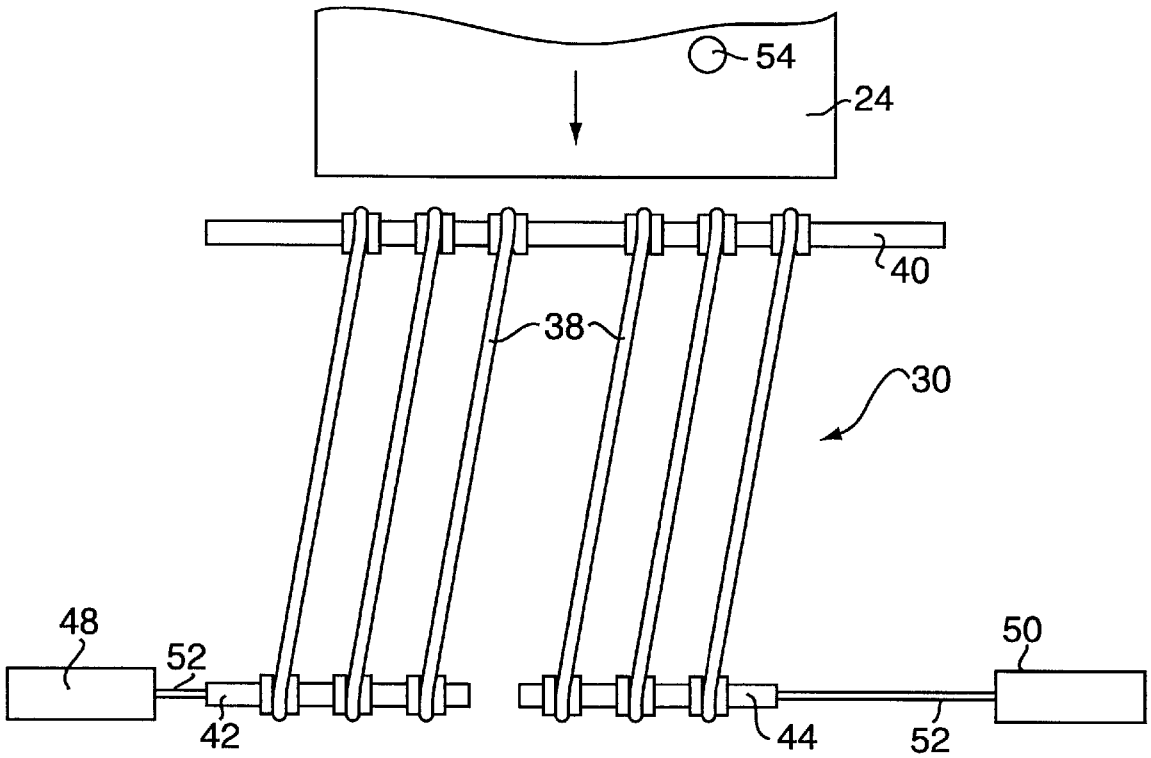
FIG. 5 is a top view of the sorting mechanism of the first alternative embodiment using split idling axles.

A mechanical stop (not shown) imposed at the downstream end of the process line (i.e. the bottom of FIG. 5) keeps the reports and individual pages thereof neatly aligned as in the preferred embodiment. Additional stops (not shown) may be mounted through the floating table 34 (shown in FIG. 1) or be supported from the side to suspend over the top of the table, so as to neatly align the outboard lateral edge of each report, similar to that described above. Such mounting provides continuous lateral stability to the entire staggered stack as the table moves lower without interfering with the table or the sorting mechanism.

Figure 7:
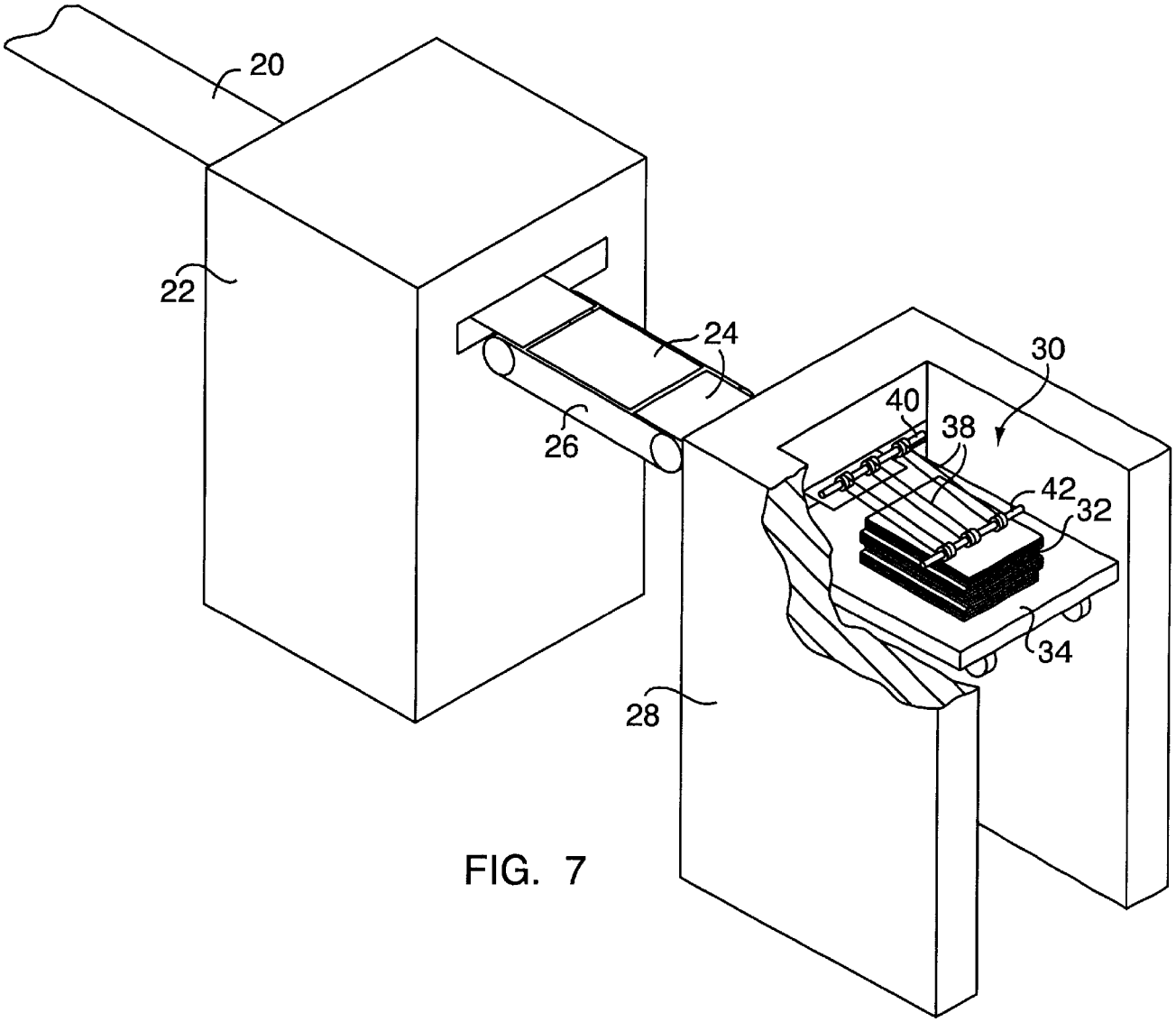
FIG. 7 is a perspective view of the sorting mechanism of the first alternative embodiment using a single idling axle, in relation to a printing process line.

Two idling axles are depicted in FIG.'S 5 and 6 for more varied applications to be described below. However, when this first alternative embodiment handles only a single stream of incoming cut sheets as discussed above, only a single idling axle and air cylinder is necessary, as shown in FIG. 7. Operation of this variation of the first alternative embodiment is identical to that described above where the two idling axles operated in unison.

Figure 8:
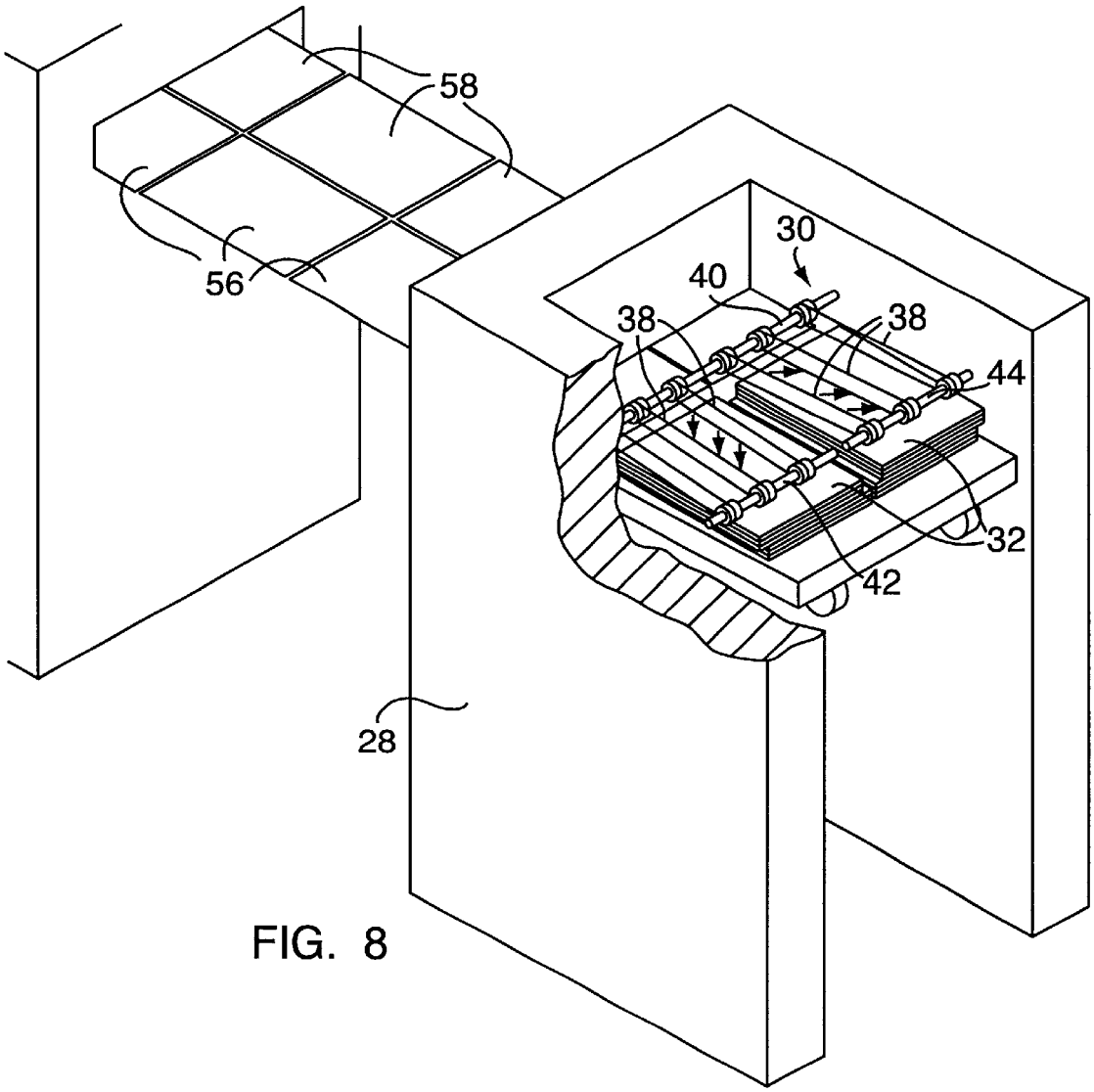
FIG. 8 is a perspective view of the second alternative embodiment in relation to a printing process line.

With minor modifications, the first alternative embodiment described above may be adapted to simultaneously handle two parallel streams of cut sheets. This second alternative embodiment is shown in FIG. 8. The conveyor bands 38 associated with the first idling axle 42 solely redirect cut pages from a first stream of documents 56 as indicated by the arrows, and the conveyor bands 38 associated with the second idling axle 44 solely redirect cut pages from a second stream of documents 58 as similarly indicated. The idling axles 42 and 44 move in the horizontal plane as in FIG. 6, but not necessarily in unison, so that two staggered stacks 32 are created side by side, commensurate with the stream of documents 56 and 58 entering the separator unit 28. The air cylinders 48 and 50 (shown in FIG. 6) may operate in either parallel or mirror fashion, whereby only one sensor is required to detect or determine the last page of a report in either the first or second streams of documents 56 and 58 (respectively). Alternatively, they may operate independently of each other, whereby the last page of each report in each of the first and second streams of documents 56 and 58 (respectively) must be independently detected or determined.

This second alternative embodiment may be modified by ordinary skill in the art to handle three parallel streams of documents by merely inserting a third idling axle and associated conveyor bands between the two sets of conveyor bands shown in FIG. 8. The horizontal position of the idling axle is controlled by a third air cylinder that is mounted above the entire sorting mechanism and attached to the third idling axle by a crank arm that has a vertical component. However, numerous side-by-side stacks of laterally staggered documents takes increasingly larger amounts of space within the separator unit, and requires progressively larger movements of the outboard idling axles and outboard streams of documents.

The third alternative embodiment is shown in FIG. 9, an adaptation to simultaneously handle three or more parallel streams of documents without the disadvantages mentioned above. Rather than compile laterally staggered stacks of reports as in previous embodiments, this adaptation builds three longitudinally staggered stacks as shown. Three sorting mechanisms, each comprising a driven axle, conveyor bands, and an idling axle, are provided to correspond to each of the side-by-side streams of documents. The longitudinally staggered stacks are formed by incrementally speeding up or slowing down the speed of each sorting mechanism's driven axle. For example, the pages of the first report in one stream are engaged by the conveyor bands driven at a slower speed, and thus staggered in the stack to be nearest to the incoming stream of documents. Upon sensing the last page of the first report and after that last page is stacked, the driven axle increases to a higher speed, and the next subsequent report is staggered in the stack furthest from the incoming stream of documents. Each of the three sorting mechanisms operate in this way to each produce a longitudinally staggered stack, and the three resulting stacks are in side-by-side relation on the floating table. It is notable that the slowest speed of the driven axle must still move each page at least as fast as the input conveyor feeds them into the present invention so that the printing process line is not slowed.

Various combinations and adaptations of the above preferred and alternative embodiments are obvious in light of the above teaching. For example, melding the configurations of FIG.'S 3 and 4 with that of FIG.'S 5 and 6 results in multiple air cylinders on each side to enable both vertical and horizontal movement of each idling axle. This melded configuration can handle two parallel streams of standard width documents, or one extra wide stream of documents. The teachings of the third alternative embodiment may be combined with any other embodiment so that the resulting combined embodiment may provide stacks that are staggered either laterally or longitudinally. These and other such combinations and permutations provide an embodiment that best fits the anticipated needs of the user.

The above preferred and alternative embodiments, with variations and combinations thereof are illustrative rather than exhaustive, and may be combined in whole or in part to attain a particular set of advantages. Such combinations and modifications thereof, are within the scope of this disclosure and will be apparent to those skilled in the art consistent with the teachings herein. The scopes of the following claims encompass such modifications and variations in accordance with the doctrine of equivalents.

I claim:

| COMPONENT DESIGNATIONS | |
|---|---|
| 20 | Web |
| 22 | Sheet cutter unit |
| 24 | Cut sheets |
| 26 | Conveyor |
| 28 | Separator unit |
| 30 | Sorting mechanism |
| 32 | Staggered stack of reports |
| 34 | Floating table |
| 36 | Observer position |
| 38 | Conveyor bands |
| 40 | Driven axle |
| 42 | First idling axle |
| 44 | Second idling axle |
| 46 | Crank arm |
| 48 | First air cylinder |
| 50 | Second air cylinder |
| 52 | Actuator |
| 54 | Optical sensor |
| 56 | First stream of documents |
| 58 | Second stream of documents |

1. A machine to separate a continuous stream of pages into discrete positions on a holding area, comprising:

conveyor means to provide a continuous stream of pages seriatim in a first direction;

means to determine which page in the continuous stream is a last page of a report;

a driven axle, an idling axle and at least one conveyor band so arranged as to frictionally move pages from the continuous stream toward the holding area; and means for shifting one of the axles to selectively direct pages to a first or a second position of the holding area.

2. The machine of claim 1, wherein said means for shifting one of the axles includes means for shifting said idling axle laterally.

3. The machine of claim 1, further comprising a second idling axle connected to said driven axle by a second conveyor band, and said means for shifting one of the axles includes means for shifting at least one of said idling axles vertically.

4. The machine of claim 1 wherein said first and second positions are staggered longitudinally.

5. A machine to separate a continuous stream of pages into discrete reports, and to provide these discrete reports in stacks in a first or a second position on a holding area, comprising:

conveyor means to move the continuous stream of pages toward the holding area;

an overhead conveyor system including a driven shaft adjacent the continuous stream of pages, and an opposing idling shaft downstream thereof, said idling shaft being shiftable to direct a last page of a report toward one of said first or second positions and the next subsequent page of the continuous stream to the other of said first or second positions.

6. The machine of claim 5 wherein said idling shaft is shiftable laterally.

7. The machine of claim 5 further comprising a number n−1 of other machines of claim 11 in side-by-side relation, so as to process n continuous streams of documents in side-by-side relation into n stacks, wherein the number n is any whole number greater than one, and wherein each machine shares a common driven shaft.

8. The machine of claim 5 wherein said idling shaft is shiftable vertically.

9. The machine of claim 5 wherein said first and second positions are staggered laterally.

10. An apparatus for sperating a stream of documents into discrete groups, and comprising;

a) input conveyor means to move at least one stream of document in a downstream direction;

b) a document support table for receiving the documents fed from said input conveyor means;

c) overhead conveyor means above said table that receives the documents so fed from said input conveyor means, said conveyor means being driven at a speed that is adjustable relative to the speed of said input conveyor means; and d) means for shifting said overhead conveyor means transversely to provide documents from said at least one stream in transversely staggered groups on said table.

11. The apparatus of claim 10 wherein said input conveyor means moves at least two side-by-side document streams, and said overhead conveyor means comprises at least a first and a second idling axle, such that conveyor means associated with said first idling axle direct documents to a first staggered group and conveyor means associated with said second idling axle direct documents to a second staggered group.

12. An apparatus for separating a stream of documents into discrete groups, and comprising:

a) input conveyor means to move at least one stream of documents in a downstream direction;

b) a document support table for receiving the documents fed from said input conveyor means;

c) overhead conveyor means above said table that receives the documents so fed from said input conveyor means, said conveyor means being driven at a speed that is adjustable relative to the speed of said input conveyor means; and d) means to further adjust the speed of said overhead conveyor means independent of said input conveyor means so as to provide documents from at least one stream in longitudinally staggered groups on said table.

13. The apparatus of claim 12 wherein a) said input conveyor means moves at least two side-by-side document streams, b) overhead conveyor means corresponding to each said side-by-side document stream; and c) means to adjust the speed of each said overhead conveyor means independent of said input conveyor means so as to provide documents in multiple longitudinally staggered groups, each corresponding to each said document stream on said table.

* * * * *